US010697257B2

(12) United States Patent
Dewald et al.

(10) Patent No.: US 10,697,257 B2
(45) Date of Patent: Jun. 30, 2020

(54) INTERLOCK SYSTEM AND METHOD FOR A DRILLING RIG

(71) Applicant: NABORS DRILLING TECHNOLOGIES USA, INC., Houston, TX (US)

(72) Inventors: Brian Dale Dewald, Calgary (CA); Doug Christian Greening, Calgary (CA)

(73) Assignee: Nabors Drilling Technologies USA, Inc., Houston, TX (US)

( * ) Notice: Subject to any disclaimer, the term of this patent is extended or adjusted under 35 U.S.C. 154(b) by 272 days.

(21) Appl. No.: 15/899,226

(22) Filed: Feb. 19, 2018

(65) Prior Publication Data

US 2019/0257161 A1 Aug. 22, 2019

(51) Int. Cl.

| | |
|---|---|
| ***E21B 19/07*** | (2006.01) |
| ***E21B 47/00*** | (2012.01) |
| *E21B 19/14* | (2006.01) |

(52) U.S. Cl.

CPC ..... *E21B 19/07* (2013.01); *E21B 47/00* (2013.01); *E21B 19/14* (2013.01)

(58) Field of Classification Search

CPC ..... E21B 19/07; E21B 47/00; E21B 19/14; E21B 31/20; E21B 19/16

See application file for complete search history.

(56) References Cited

U.S. PATENT DOCUMENTS

| | | | |
|---|---|---|---|
| 5,791,410 | A | 8/1998 | Castille et al. |
| 7,086,461 | B2 | 8/2006 | Schulze-Beckinghausen et al. |
| 7,281,587 | B2 | 10/2007 | Haugen |
| 8,074,711 | B2 | 12/2011 | Ellis et al. |
| 8,136,603 | B2 | 3/2012 | Schneider |
| 8,356,675 | B2 | 1/2013 | Pietras et al. |
| 8,439,121 | B2 | 5/2013 | Nikiforuk et al. |
| 9,206,657 | B2 | 12/2015 | Kuttel et al. |
| 2007/0131416 | A1 | 6/2007 | Odell, II et al. |
| 2008/0264648 | A1 | 10/2008 | Bernd-Georg et al. |
| 2009/0151934 | A1 | 6/2009 | Heidecke et al. |
| 2009/0272542 | A1 | 11/2009 | Begnaud et al. |
| 2009/0274545 | A1* | 11/2009 | Liess ..... E21B 19/16 414/800 |
| 2011/0048737 | A1 | 3/2011 | Schneider |
| 2012/0043071 | A1 | 2/2012 | Matherne, Jr. et al. |
| 2012/0055682 | A1 | 3/2012 | Bouligny et al. |
| 2012/0152530 | A1 | 6/2012 | Wiedecke et al. |
| 2013/0118760 | A1 | 5/2013 | Kuttel et al. |

FOREIGN PATENT DOCUMENTS

| | | |
|---|---|---|
| CA | 2773174 | 9/2013 |
| WO | 02/092959 | 11/2002 |

* cited by examiner

*Primary Examiner* — Brad Harcourt

(74) *Attorney, Agent, or Firm* — Enrique Abarca; Abel Schillinger, LLP

(57) ABSTRACT

A system includes a casing running tool and a tubular measurement system coupled to an internal shaft of the casing running tool and configured to measure data indicative of a grappling force of the casing running tool on a tubular. The measured data indicative of the grappling force includes a number of turns of the internal shaft and/or a torque experienced by the internal shaft.

19 Claims, 8 Drawing Sheets

INTERLOCK SYSTEM AND METHOD FOR A DRILLING RIG

BACKGROUND

Embodiments of the present disclosure relate generally to the field of drilling and processing of wells. More particularly, present embodiments relate to a system for supporting a length of tubular during a drilling operation.

In conventional oil and gas operations, a well is typically drilled to a desired depth with a drill string, which includes drill pipe and a drilling bottom hole assembly (BHA). Once the desired depth is reached, the drill string is removed from the hole and casing is run into the vacant hole. In some conventional operations, the casing may be installed as part of the drilling process. A technique that involves running casing at the same time the well is being drilled may be referred to as "casing-while-drilling."

Casing may be defined as pipe or tubular that is placed in a well to prevent the well from caving in, to contain fluids, and to assist with efficient extraction of product. When the casing is run into the well, the casing may be internally gripped by a grappling system of a top drive. Specifically, the grappling system may exert an internal pressure or force on the casing to prevent the casing from sliding off the grappling system. With the grappling system engaged with the casing, the weight of the casing is transferred to the top drive that hoists and supports the casing for positioning down hole in the well.

When the casing is properly positioned within a hole or well, the casing is typically cemented in place by pumping cement through the casing and into an annulus formed between the casing and the hole (e.g., a wellbore or parent casing). Once a casing string has been positioned and cemented in place or installed, the process may be repeated via the now installed casing string. For example, the well may be drilled further by passing a drilling BHA through the installed casing string and drilling. Further, additional casing strings may be subsequently passed through the installed casing string (during or after drilling) for installation. Indeed, numerous levels of casing may be employed in a well. For example, once a first string of casing is in place, the well may be drilled further and another string of casing (an inner string of casing) with an outside diameter that is accommodated by the inside diameter of the previously installed casing may be run through the existing casing. Additional strings of casing may be added in this manner such that numerous concentric strings of casing are positioned in the well, and such that each inner string of casing extends deeper than the previously installed casing or parent casing string.

BRIEF DESCRIPTION

In accordance with one aspect of the disclosure, a system includes a casing running tool and a tubular measurement system coupled to an internal shaft of the casing running tool and configured to measure data indicative of a grappling force of the casing running tool on a tubular. The measured data indicative of the grappling force includes a number of turns of the internal shaft and/or a torque experienced by the internal shaft.

In accordance with another aspect of the disclosure, a system includes a controller configured to coordinate operation of a grappling device of a top drive system to ensure that grapples of the grappling device are adequately engaged with a tubular to support a weight of the tubular. The controller is configured to determine a gripping force of the grappling device on the tubular based on measured feedback. The measured feedback includes a torque experienced by an internal shaft of the grappling device and a number of rotations traveled by the internal shaft of the grappling device.

In accordance with yet another aspect of the disclosure, a method includes inserting a grappling device of a tubular drive system of a drilling rig into a tubular, abutting a bumper of the grappling device against an axial face of the tubular, and rotating an internal shaft of the grappling device relative to the bumper and the tubular. Rotating the internal shaft of the grappling device relative to the bumper and the tubular actuates grapples of the grappling device to radially extend toward an internal surface of the tubular. The method also includes measuring data indicative of a number of rotations of the internal shaft, a torque experienced by the internal shaft, and a compression experienced by the internal shaft. The method further includes determining a grappling force of the grapples on the internal surface of the tubular based on the measured data.

DRAWINGS

These and other features, aspects, and advantages of the present disclosure will become better understood when the following detailed description is read with reference to the accompanying drawings in which like characters represent like parts throughout the drawings, wherein.

Figure 11:
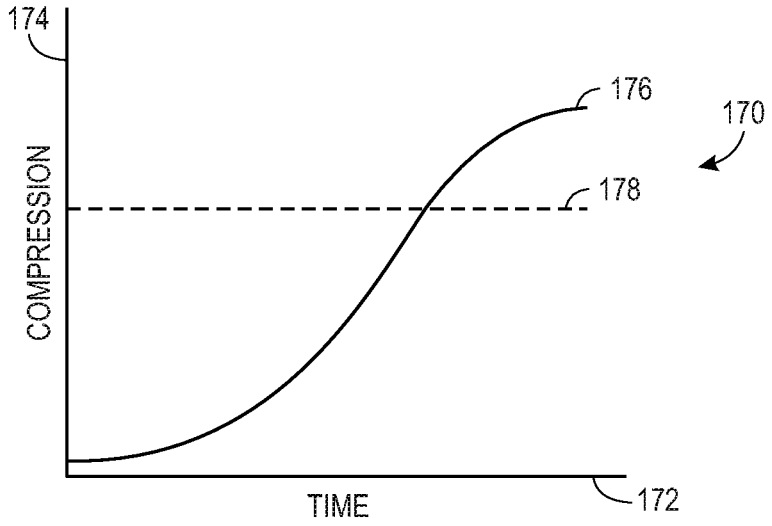
Figure 12:
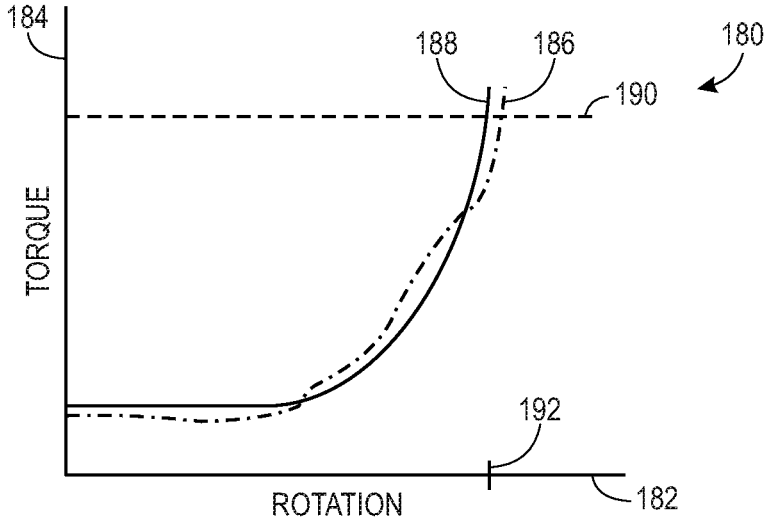
Figure 13:
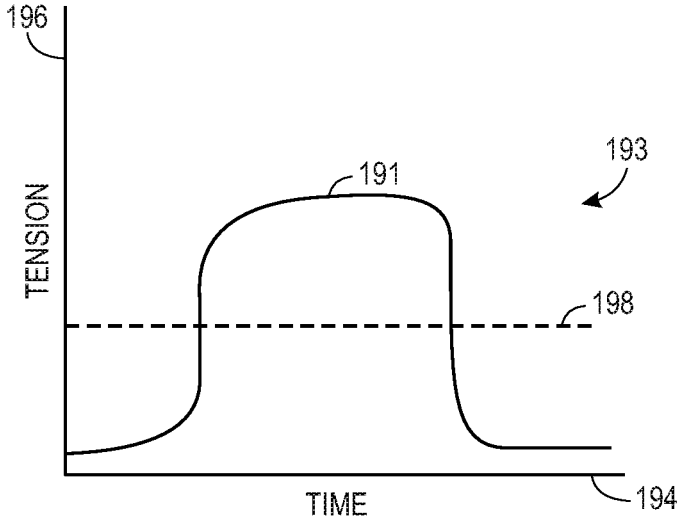

FIG. 11 is schematic of an embodiment of a parameter relationship that the interlock system may utilize, in accordance with present techniques FIG. 12 is schematic of an embodiment of a parameter relationship that the interlock system may utilize, in accordance with present techniques; and FIG. 13 is a schematic of an embodiment of a parameter relationship that the interlock system may utilize, in accordance with present techniques.

DETAILED DESCRIPTION

Present embodiments provide an interlock system to monitor, regulate, and coordinate the operation of one or more components of a drilling rig during a casing running operation to ensure that lengths of tubular (e.g., casing) are continually supported by a component of the drilling rig. For example, the interlock system may be configured to regulate operation of a grappling device of a top drive system or other tubular drive system, power slips positioned near a rig floor of the drilling rig, or other component of the drilling rig configured to support the weight of the tubular or a casing string. More particularly, the grappling device may include a bumper and rotationally-actuated grapples. The bumper may abut an axial face of the tubular while an internal shaft of the grappling device rotates, thereby actuating the grapples to extend radially outward and interface (e.g., grapple) with an internal surface of the tubular. Furthermore, the interlock system may be configured to regulate and coordinate operation of the one or more components of the drilling rig based on measured feedback associated with a casing running operation. For example, the interlock system may include one or more sensors and/or monitoring systems configured to measure forces (e.g., weight, torque, etc.) acting on the one or more components of the drilling rig, such as a weight of tubular acting on the grappling device and/or the power slips. In some embodiments, the interlock system may also measure rotations, e.g., of the internal shaft of the grappling device, or an element of the top drive system. Based on the measured feedback, the interlock system may coordinate operation of the grappling device and the power slips to ensure that at least one of the grappling device and the power slips is supporting a weight of the tubular and the casing string.

Figure 1:
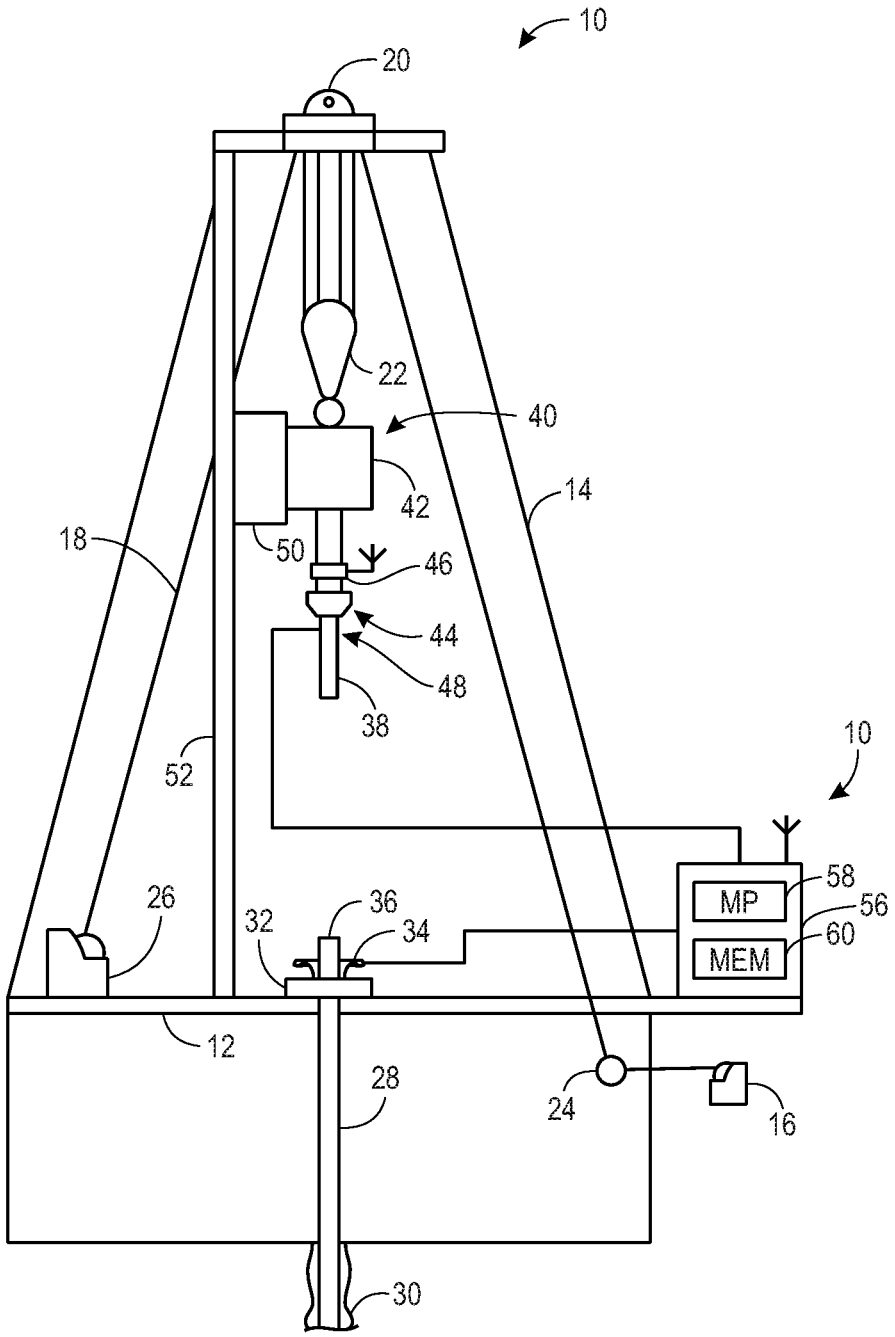
FIG. 1 is a schematic of an embodiment of a well being drilled with interlock system, in accordance with present techniques.

Turning now to the drawings, FIG. 1 is a schematic of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34 (e.g., power slips). A portion of the drill string 28 extends above the rig floor 12, forming a stump 36 to which another length of tubular 38 (e.g., a joint of drill pipe) may be added.

A tubular drive system 40, hoisted by the traveling block 22, positions the tubular 38 above the wellbore 30. In the illustrated embodiment, the tubular drive system 40 includes a top drive 42, a grappling device 44 (e.g., casing running tool), and a tubular measurement system 46 (e.g., an operating parameter monitoring system) configured to measure parameters of the tubular drive system 40, such as torque, weight, compression, tension, turns, and so forth. For example, to obtain the parameters, the tubular measurement system 46 may measure forces acting on the tubular drive system 40 via sensors, such as strain gauges, gyroscopes, pressure sensors, accelerometers, magnetic sensors, optical sensors, or other sensors, which may be communicatively linked or physically integrated with the tubular measurement system 46. The grappling device 44 of the tubular drive system 40 is engaged with a distal end 48 (box end) of the tubular 38. The tubular drive system 40, once coupled with the tubular 38, may then lower the coupled tubular 38 toward the stump 36 and rotate the tubular 38 such that it connects with the stump 36 and becomes part of the drill string 28. FIG. 1 further illustrates the tubular drive system 40 coupled to a torque bushing system 50. More specifically, the torque bushing system 50 couples the tubular drive system 40 to a torque track 52. The torque bushing system 50 and the torque track 52 function to counterbalance (e.g., counter react) moments (e.g., overturning and/or rotating moments) acting on the tubular drive system 40 and further stabilize the tubular drive system 40 during a casing running operation or other operation.

The drilling rig 10 further includes an interlock system 54, which is configured to control the various systems and components of the drilling rig 10 that grip, lift, release, and support the tubular 38 and the drill string 28 during a casing running operation. For example, the interlock system 54 may control operation of the grappling device 44 and the power slips 34 based on measured feedback (e.g., from the tubular measurement system 46 and other sensors) to ensure that the tubular and the drill string 28 are adequately gripped and supported by the grappling device 44 and/or the power slips 34 during a casing running operation. In this manner, the interlock system 54 may reduce and/or eliminate incidents where lengths of tubular 38 and/or the drill string 28 are not adequately supported.

In the illustrated embodiment, the interlock system 54 includes a controller 56 having one or more microprocessors 58 and a memory 60. For example, the controller 56 may be an automation controller, which may include a programmable logic controller (PLC). The memory 60 is a non-transitory (not merely a signal), computer-readable media, which may include executable instructions that may be executed by the microprocessor 56. The controller 56 receives feedback from the tubular measurement system 46 and/or other sensors that detect measured feedback associated with operation of the drilling rig 10. For example, the controller 56 may receive feedback from the tubular drive system 46 and/or other sensors via wired or wireless transmission. Based on the measured feedback, the controller 56 regulates operation of the grappling device 44 and the power slips 34. In particular, the operation of the grappling device 44 and the power slips 34 may be coordinated by the controller 56 to ensure that at least one of the grappling device 44 and/or the power slips 34 is adequately gripping and supporting the weight of the tubular 38 and/or the drill string 28 (e.g., during a casing running operation). In certain embodiments, the controller 56 may also be configured to regulate operation of other components of the drilling rig 10, such as the top drive 42. The coordinated operation of the grappling device 44 and the power slips 34 is discussed in further detail below.

It should be noted that the illustration of FIG. 1 is intentionally simplified to focus on the interlock system 54 of the drilling rig 10, which is described in greater detail below. Many other components and tools may be employed during the various periods of formation and preparation of the well. Similarly, as will be appreciated by those skilled in the art, the orientation and environment of the well may vary widely depend upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

Figure 2:
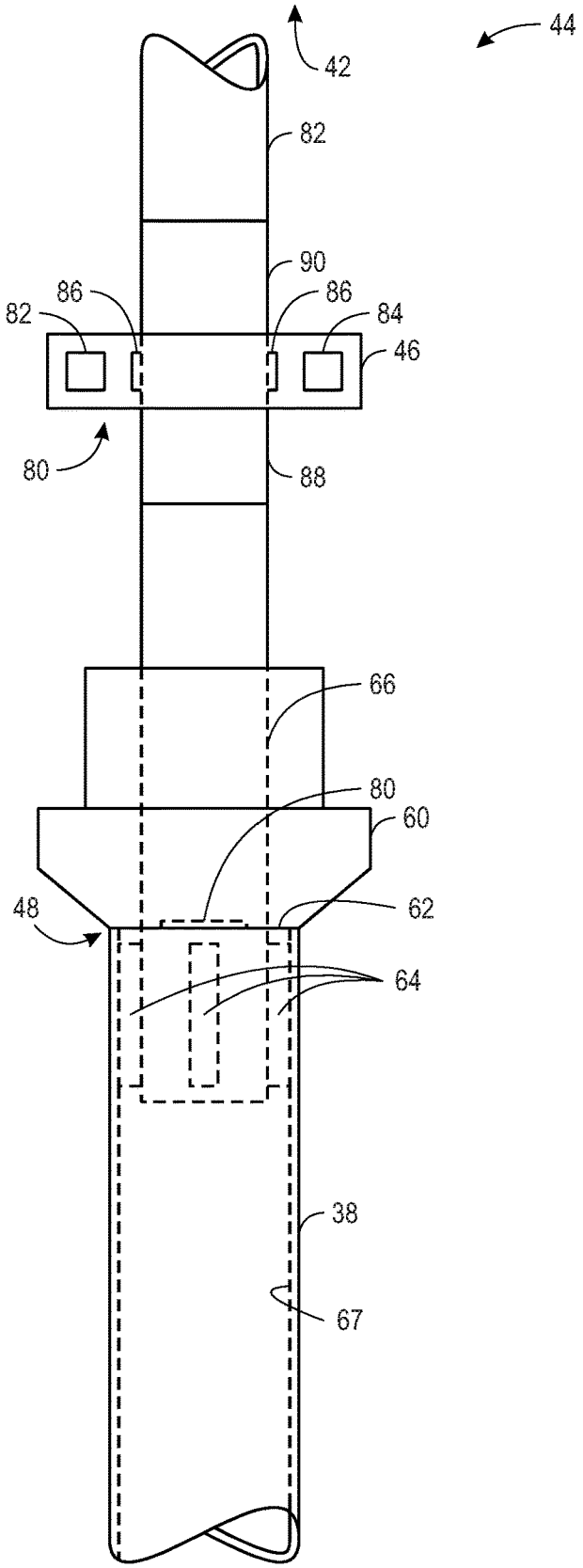
FIG. 2 is a schematic of an embodiment of a tubular measurement system of the interlock system, in accordance with present techniques.

FIG. 2 is a schematic of the tubular measurement system 46 and the grappling device 44. In the illustrated embodiment, the grappling device 44 is engaged with the tubular 38 (e.g., casing). Particularly, a bumper 60 is abutting an axial face 62 of the tubular 38 while grapples 64 are extended from an internal shaft 66 of the grappling device 44 and are engaged with an internal surface 67 of the tubular 38. In this manner, the grappling device 44 may be coupled with the tubular 38, and in some embodiments, may fully support the weight of the tubular 38.

To elaborate, in some embodiments, the grappling device 44 may retrieve the tubular 38 from a staging area (e.g., a catwalk, v-door, skate) positioned generally adjacent to the drilling rig 10. Once the grappling device 44 has retrieved the tubular 38 from the staging area, the grappling device 44 may position the tubular 38 above the stump 36 to be coupled to the drill string 28 (e.g., a running operation) as described above with reference to FIG. 1. Further, in some embodiments, the tubular 38 may be positioned above the stump 36 by a tubular handling device (e.g., gripping device, tubular manipulator, elevators, etc.), whereby the grappling device 44 may couple to the tubular 38 after the tubular 38 has been positioned above the stump 36. Regardless, to couple to the tubular 38 (e.g., while in the staging area, or as it is held by the tubular handling device above the stump 36), the grappling device 44 may insert the internal shaft 66 into the distal end 48 of the tubular 38 such that the bumper 60 abuts the axial face 62. In some embodiments, a compressive force between the bumper 60 and the axial face 62 may be monitored to determine whether the bumper 60 is applying an adequate amount of force to the tubular 38. For example, as discussed below, the tubular measurement system 46 may monitor a bumper force of the bumper 60 on the tubular 38 and compare the bumper force to a predetermined bumper force threshold to determine whether the bumper 60 is applying sufficient force to the axial face 62 of the tubular 38. Once the tubular measurement system 46 determines that the bumper 60 is applying sufficient force to the axial face 62 of the tubular 38, the internal shaft 66 may be rotated relative to the bumper 38 and the tubular 38, thereby pushing the grapples 64 radially outward from the internal shaft 66, such that the grapples 66 interface with the internal surface 67 of the tubular 38. Indeed, as the internal shaft 66 rotates, the tubular handling device mentioned above may block the tubular 38 from rotating. Further, because the bumper 60 is pressed against the axial face 62 of the tubular 38, the bumper 60 may be held rotationally still relative to the tubular 38 while the internal shaft 66 continues to rotate, thereby actuating the grapples 64. Therefore, to help block movement of the bumper 60 relative to the tubular 38, the bumper 60 may include a high-friction material (e.g., rubber, some metals, etc.), thereby increasing the coefficient of friction between the bumper 60 and the tubular 38.

To ensure that the grappling device 44 is fully engaged with the tubular 38, the tubular measurement system 46 may measure various parameters acting on the internal shaft 66. For example, the tubular measurement system 46 may measure torque, rotation, tension, compression, downward force etc. acting on the internal shaft 66. To this end, the tubular measurement system 46 may include various sensors 80 such as a linear accelerometer 82, a gyroscope 84, and one or more strain gauges 86. In other embodiments, additional sensors 80 may be included as part of the tubular measurement system 46, such as additional accelerometers, gyroscopes, magnetometers, compasses (e.g., a digital compass), pressure sensors, or other types of sensors.

Specifically, the linear accelerometer 82 and the gyroscope 84 may be configured to measure acceleration, rotation, angular velocity, vibration, inertia, or other parameters indicative of movement. The strain gauges 86 may be disposed on an outer surface 88 of the internal shaft 66. In particular, multiple strain gauges 86 may be positioned circumferentially (e.g., equidistantly or substantially equidistantly) about the outer surface 88 of the internal shaft 66. For example, 1, 2, 3, 4, 5, 6, 7, 8, 9, 10, or more strain gauges 86 may be positioned (e.g., circumferentially) on the outer surface 88 of the internal shaft 66. In other embodiments, the strain gauges 86 may be spaced or arranged in other configurations. In some embodiments, the strain gauges 86 may be disposed on a narrowed diameter section of the outer surface 88 of the internal shaft 66 to increase sensitivity of the interlock system 54. As will be appreciated, the strain gauges 86 are configured to measure strain (e.g., tension and compression forces) acting on the internal shaft 66. For example, the strain gauges 86 may be flexible, adhesive sensors that include a metallic foil pattern configured to deform and change in electrical resistance when a tension force or compression force is applied to the internal shaft 66.

As discussed herein, the tubular measurement system 46 is configured to measure various parameters of the internal shaft 66 (e.g., torque, tension, compression, downward force, rotations, etc.). However it should be noted that, in certain embodiments, the tubular measurement system 46 may be coupled to the internal shaft 66 via a saver sub 90. Indeed, in such embodiments, the internal shaft 66 may transfer forces that are indicative of the various parameters of the internal shaft 66 to the saver sub 90, which are then measured by the tubular measurement system 46. Therefore, it is to be understood that, as discussed herein, the various parameters of the internal shaft 66 that are measured by the tubular measurement system 46 may be indirectly measured through the saver sub 90.

Figure 3:
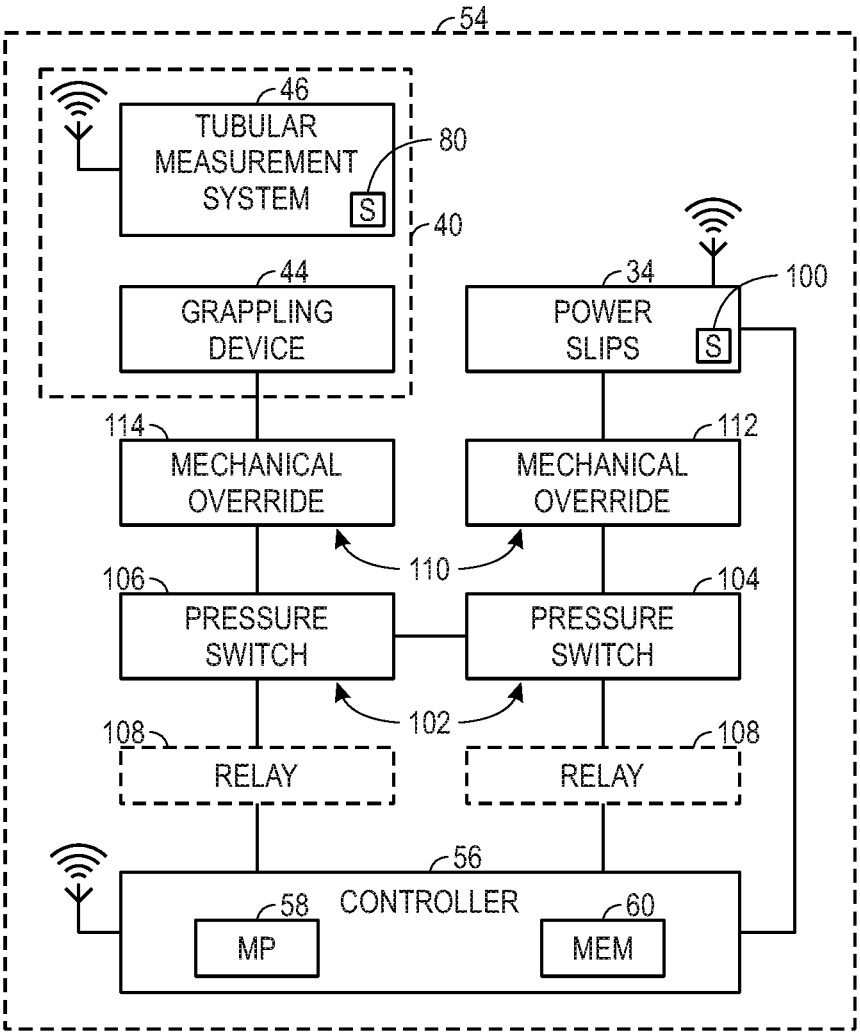
FIG. 3 is a block diagram of an embodiment of the interlock system, in accordance with present techniques.

FIG. 3 is a schematic representation of the interlock system 54 for the drilling rig 10. As mentioned above, the interlock system 54 includes the controller 56, which is configured to regulate and coordinate operation of the grappling device 44 and the power slips 34 (e.g., based on measured operating parameter feedback) to ensure that the tubular 38 and the drill string 28 are supported by the grappling device 44, the power slips 34, or both. The controller 56 may receive measured feedback via wired or wireless transmission from the tubular measurement system 46, sensors 80 of the tubular measurement system 46, sensors 100 of the power slips 34, or other components of the drilling rig 10. The measured feedback provided by the tubular measurement system 46 and the sensors 100 of the power slips 34 is described in further detail below. Furthermore, it will be appreciated that each of the types of measured feedback described below may be used in any combination with one another to coordinate operation of the grappling device 44 and the power slips 34.

In the illustrated embodiment, the controller 56 is configured to control operation of the power slips 34 and the grappling device 44 by applying control signals to pressure switches 102 of the interlock system 54. In particular, the interlock system 54 includes a first pressure switch 104 for actuating the power slips 34 and a second pressure switch 106 for actuating the grappling device 44. In certain embodiments, the interlock system 54 may also include relays 108 for amplifying the control signals of the controller 56 before the control signals are sent to the pressure switches 102. The pressure switches 102 may also enable the controller 56 to detect a gripping force (e.g., grappling force) of the grappling device 44 and/or the power slips 34 on the tubular 38 and/or the drill string 28. As discussed, below, in some embodiments, the gripping force of the grappling device 44 may be determined by comparing measurements obtained from the sensors 80 of the tubular measurement system 46 to torque vs. rotation profile, a tension threshold, and/or a compression threshold. As a result, the controller 56 may be configured to detect that the grappling device 44 and/or the power slips 34 are gripping the tubular 38 and/or drill string 28 with sufficient force to ensure that the tubular 38 and/or the drill string 28 are properly gripped. Additionally, the pressure switches 102 may be configured to block disengagement (e.g., "lockout") of the grappling device 44 and/or the power slips 34 until sufficient pressure is applied to the other of the grappling device 44 and/or the power slips 34 to support the tubular 38 and/or the drill string 28. For example, the second pressure switch 106 may be configured to block disengagement of the power slips 34 until sufficient pressure is applied to the grappling device 44 for gripping and supporting the tubular 38 and/or the drill string 28. Similarly, the first pressure switch 104 may be configured to block disengagement of the grappling device 44 until sufficient pressure is applied to the power slips 34 for gripping and supporting the tubular 38 and/or the drill string 28. For example, the pressure switches 102 may be configured to react to physically react to hydraulic pressures of one another.

The interlock system 54 may also use other measured feedback to coordinate operation of the grappling device 44 and the power slips 34. For example, the tubular measurement system 46 may be configured to detect a gripping distance (e.g., a radial gripping or closing distance) that the grappling device 44 has traveled (e.g., radially outward) to grip the internal surface 67 of the tubular 38. In certain embodiments, the gripping distance traveled by the grappling device 44 may be measured using sensors, such as magnetic sensors, Hall-effect sensors, optical sensors, or other suitable types of sensors, which may be coupled to the grappling device 44. In some embodiments, the gripping distance traveled by the grappling device 44 may be calculated based on the rotation of the internal shaft 66 relative to the bumper 60. The gripping distance traveled by the grappling device 44 to grip the internal surface 67 of the tubular 38 may be directly related to a gripping force (e.g., grappling force) of the grappling device 44 on the tubular 38. Indeed, in some embodiments, the gripping distance of the grappling device 44 may be monitored to determine whether the grappling device 44 is adequately gripping the tubular 38. The sensors 100 of the power slips 34 may similarly calculate a gripping distance (e.g., radially gripping or closing distance) that the power slips 34 have traveled to grip the drill string 28. As will be appreciated, the measured gripping distance traveled by the grappling device 44 and/or power slips 34 may be used to further calculate a gripping force of the power slips 34 and/or grappling device 44. In some embodiments, as discussed below, the gripping force of the grappling device 44 may be determined based on the torque experienced by the internal shaft 66 and measured by the sensors 80 of the tubular measurement system 46. Additionally, the measured gripping distances may be used to verify that the grappling device 44 and/or power slips 34 have properly gripped the tubular 38 and/or drill string 28 instead of another component, such as a collar. In other words, the gripping distance may correspond to an expected diameter of the tubular 38 and/or the drill string 28.

The interlock system 54 further includes mechanical overrides 110, which may be used to enable releasing or disengagement of the power slips 34 and/or grappling device 44 at a desired time. In other words, the mechanical overrides 110 interrupt control of the power slips 34 and/or grappling device 44 by the controller 56 to enable immediate or instant disengagement of the power slips 34 and/or grappling device 44. For example, a first mechanical override 112 may be actuated to enable disengagement of the power slips 34, and a second mechanical override 114 may be actuated to enable disengagement of the grappling device 44. In certain embodiments, the interlock system 54 may include one mechanical override 110 to enable disengagement of both the power slips 34 and the grappling device 44 at the same time. In one embodiment, the mechanical overrides 110 may be operated with a key that is turned by a user or operator to actuate the mechanical override 110 and disengage the power slips 34 or the grappling device 44.

As will be appreciated, the interlock system 54 shown in FIG. 3 is simplified to focus on the coordinated control of the components of the drilling rig 10 during drilling operation (e.g., a casing running or tripping operation). As such, it will be appreciated that the interlock system 54 may include other components to facilitate operation of the drilling rig 10 components, such as the grappling device 44 and the power slips 34. For example, the interlock system 54 may include additional valves, electronics, switches, sensors, or other components to enable operation of the gripping device and the power slips 34.

FIGS. 4-10 are schematic representations of an embodiment of the drilling rig 10 and interlock system 54, illustrating operation of the interlock system 54 during a casing running operation.

Figure 4:
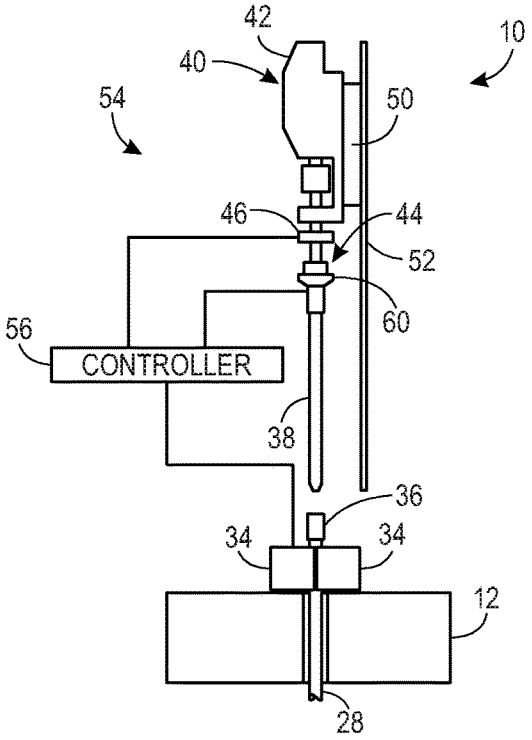
FIG. 4 is a schematic of an embodiment of a well, illustrating operation of the interlock system, in accordance with present techniques.

In FIG. 4, the tubular drive system 40 has just picked up the tubular 38 for connection to the drill string 28. As such, the grappling device 44 is in a locked and engaged position. In particular, the controller 56 is controlling the grappling device 44 to ensure that the grappling device 44 is adequately gripping the tubular 38 to support the position, and the controller 56 is controlling the power slips 34 to ensure that the power slips 34 are adequately gripping the drill string 28 to support the weight of the drill string 28. For example, in some embodiments, the controller 56 may include an algorithm (e.g., stored in the memory 60) configured to calculate a desired gripping force as a function of a weight supported by the grappling device 44 and/or power slips 34, a distance (e.g., radial gripping or closing distance) that the grappling device 44 and/or power slips have moved to grip the tubular 38 or drill string 28, or other measured parameter. In some embodiments as described below, the controller 56 may be configured to calculate the desired gripping force as a function of rotation and torque. For example, as the internal shaft 66 rotates relative to the bumper 60, the grapples 64 may extend to engage with the internal surface 67 of the tubular 38. Accordingly, the rotations of the internal shaft 66 may be monitored to determine whether the grapples 64 of the grappling device 44 have adequately extended to sufficiently grip the internal surface 67 of the tubular 38. Further, once the grapples 64 of the grappling device 44 have extended to engage with the internal surface 67 of the tubular 38, further rotation of the internal shaft 67 may cause the internal shaft 66 to experience a reactive torque. Particularly, the reactive torque experienced by the internal shaft 66 may be due to the gripping force of the grapples 44 on the tubular 38 preventing further rotation of the internal shaft 66 relative to the tubular 38. Such functions may be stored in the memory 60 as a look-up table, graph, relationship, equation, etc.

Figure 5:
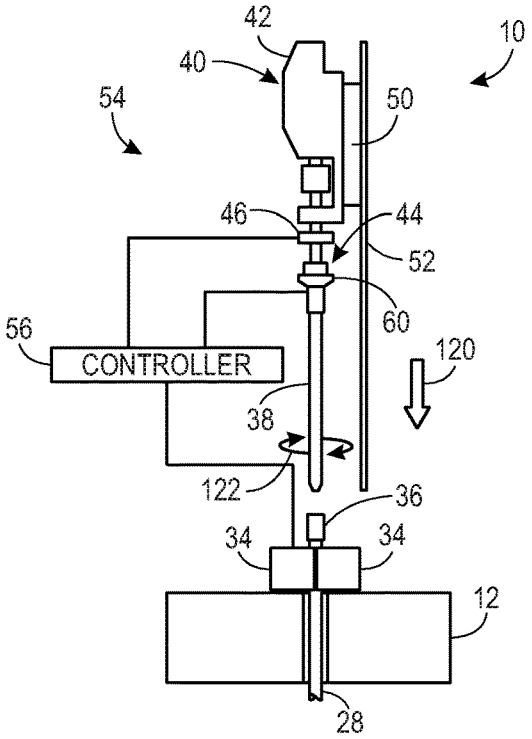
FIG. 5 is a schematic of an embodiment of a well, illustrating operation of the interlock system, in accordance with present techniques.

As shown in FIG. 5 and indicated by arrow 120, the tubular drive system 40 lowers the tubular 38 toward the stump 38 of the drill string 28 for connection of the tubular 38 to the drill string 28. Additionally, as indicated by arrow 122, the top drive 42 rotates the tubular 38 as the tubular 38 is lowered to the stump 36 of the drill string 28 by the tubular drive system 40. In the embodiment shown in FIG. 5, the controller 56 continues to operate the grappling device 44 and the power slips 34 such that the grappling device 44 and the power slips 34 are both in the locked and engaged position. In this manner, the tubular 38 and the drill string 28 both remain gripped and supported. Furthermore, while the tubular 38 is connected to the drill pipe 38, the controller 56 continues to regulate the grappling device 44 and power slips 34 such that both are in the engaged and locked position.

Figure 6:
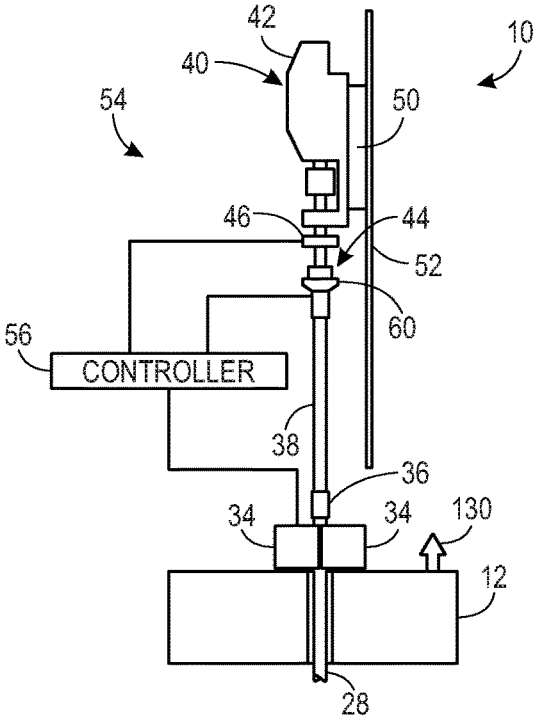
FIG. 6 is a schematic of an embodiment of a well, illustrating operation of the interlock system, in accordance with present techniques.
Figure 7:
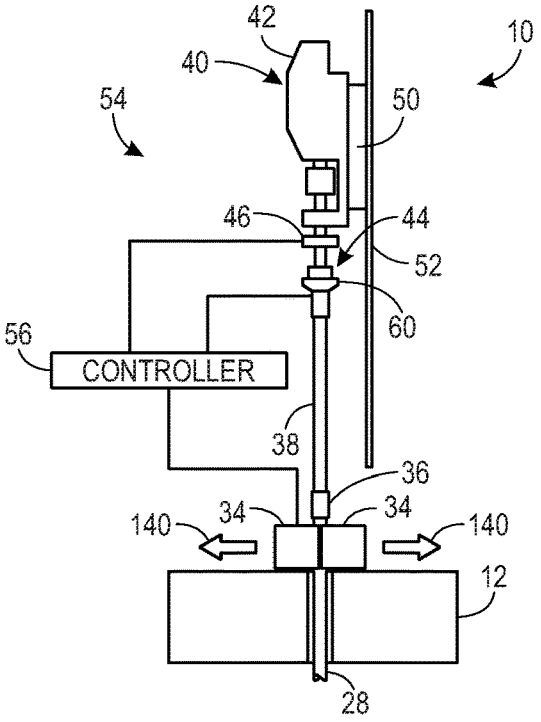
FIG. 7 is a schematic of an embodiment of a well, illustrating operation of the interlock system, in accordance with present techniques.

FIG. 6 illustrates an embodiment of the drilling rig 10 and interlock system 54 once the tubular 38 is connected to the stump 36 of the drill string 28. In other words, in FIG. 6, the tubular 38 is a part of the drill string 28. Once the tubular 38 is connected to the drill string 28, the top drive 42 may lift the entire drill string 28 upwards, as indicated by arrow 130. While the top drive 42 is lifting the drill string 28, the tubular measurement system 46 may measure a weight or downward force acting on the top drive 42, the grappling device 44, and/or the internal shaft 66. For example, as discussed above, the tubular measurement system 46 may include strain gauges, accelerometers, or other sensors (e.g., sensors 80) configured to measure a force acting on the top drive 42 and/or the grappling device 44 (e.g., a weight of the combined tubular 38 and drill string 28). In some embodiments, as described below in FIG. 13, the interlock system 54 may detect that the top drive 42 and/or grappling device 44 are supporting the weight of the drill string 28 by comparing the measured force to a force threshold (e.g., tension threshold). Once the tubular measurement system 46 detects that the top drive 42 and/or the grappling device 44 are supporting the weight of the drill string 28, the controller 56 may then send control signals to the power slips 34 to disengage and unlock the power slips, as indicated by arrows 140 of FIG. 7. For example, the controller 56 may be configured to send control signals to the power slips 34 to disengage and unlock the power slips 34 once the tubular measurement system 46 has detected a threshold force (e.g., a preset number of pounds) acting on the top drive 42 and/or the grappling device 44.

Figure 8:
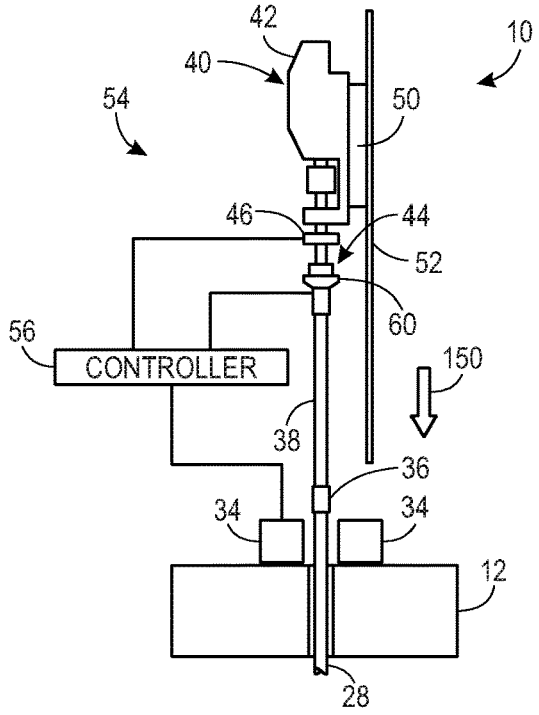
FIG. 8 is a schematic of an embodiment of a well, illustrating operation of the interlock system, in accordance with present techniques.
Figure 9:
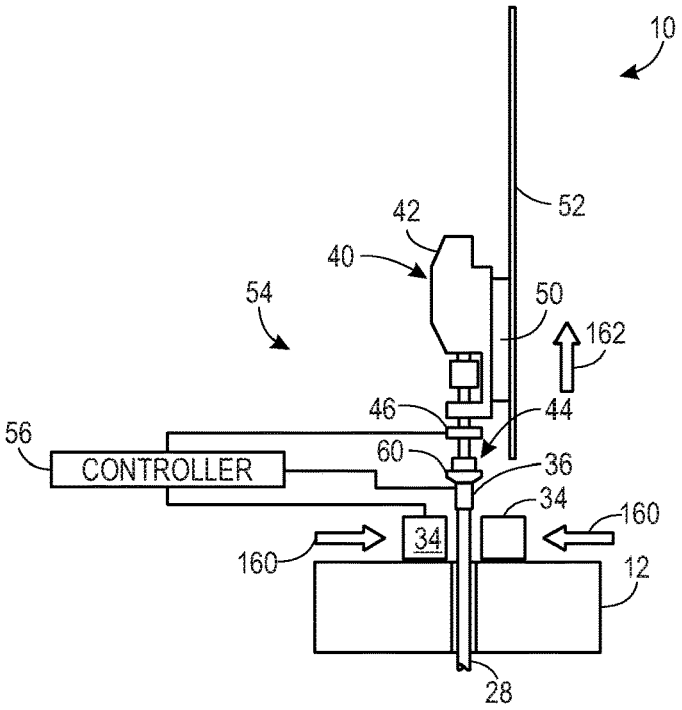
FIG. 9 is a schematic of an embodiment of a well, illustrating operation of the interlock system, in accordance with present techniques.
Figure 10:
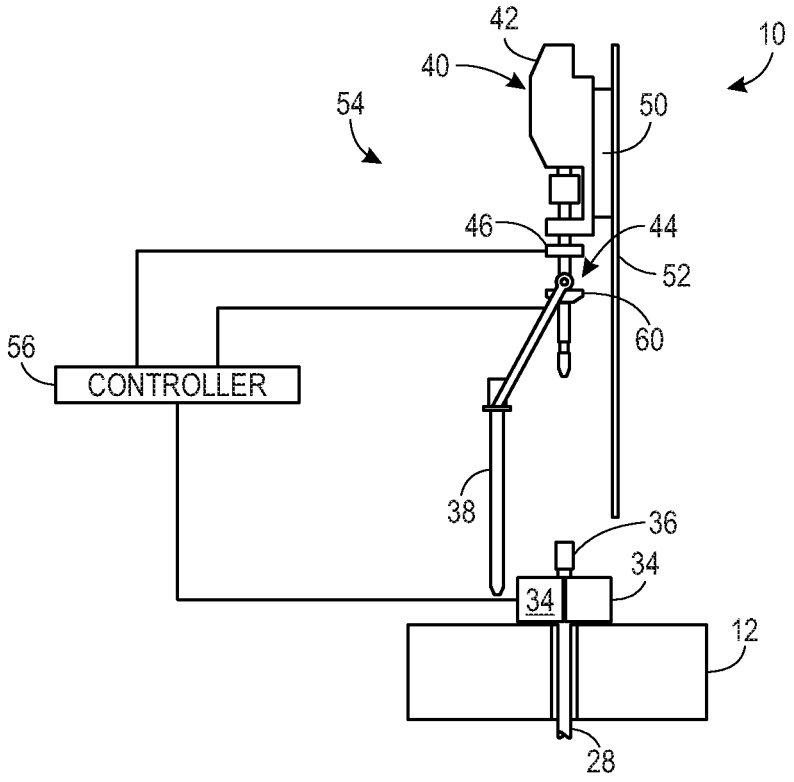
FIG. 10 is a schematic of an embodiment of a well, illustrating operation of the interlock system, in accordance with present techniques.

After the power slips 34 are unlocked and disengaged, the tubular drive system 40, which is supporting the entire weight of the drill string 28 via the engagement of the grappling device 44 with the tubular 38/drill string 28, will lower the drill string 28 further into the wellbore 30, as indicated by arrow 150 of FIG. 8. Once the drill string 28 is positioned at the proper height (e.g., relative to the power slips 34 and/or rig floor 12), the controller 56 may send control signals to the power slips 34 to lock, grip, and engage with the drill string 28, as indicated by arrows 160 of FIG. 9. After the power slips 34 grip the drill string 28, the weight of the drill string 28 supported by the grappling device 44 may be reduced. As mentioned above, the weight of the drill string 28 supported by the grappling device 44 may be compared to a threshold (e.g., tension threshold as seen in FIG. 13) to determine whether the grappling device 44 is supporting the weight of the drill string 28. Once the tubular measurement system 46 detects that the tubular drive system 40 (e.g., the grappling device 44) is supporting zero or negative weight (e.g., zero weight of the drill string 28 and/or an upward force acting on the tubular drive system 40 instead of a downward force), the controller 56 may send control signals to disengage and unlock the grappling device 44. In other words, the controller 56 may not send control signals to the grappling 44 to unlock and disengage until the tubular measurement system 46 detects that the grappling device 44 and/or top drive 42 are not supporting any weight or are not supporting weight above a certain threshold (e.g., a preset number of pounds). Thereafter, the tubular drive system 40 may travel up the torque track 52, as indicated by arrow 162, and prepare to lift another section of tubular 38 for coupling to the drill string 28. When the tubular drive system 40 is raised, the controller 56 may send control signals to the grappling device 44 to engage and grip another tubular 38 as shown in FIG. 10 and the process described above may be repeated to add another length of tubular 38 to the drill string 28.

As mentioned above, the bumper 60 may apply force to the axial face 62 of the tubular 38 to enable the internal shaft to rotate relative to the bumper 60 and the tubular 38. To this end, FIG. 11 is a graph depicting an embodiment of a compression-time relationship 170, which may be utilized by the tubular measurement system 46 and/or the interlock system 54 to determine whether the bumper 60 is applying adequate force to the axial face 62 to block slipping of the tubular 38 relative to the bumper 60, thereby enabling rotation of the internal shaft 66 relative to the bumper 60 and the tubular 38. Particularly, the X-axis 172 represents time and the Y-axis 174 represents compression 176 (e.g., compressive force), or a downward force, experienced by the internal shaft 66 and/or the bumper 60. The tubular measurement system 46 may measure the compression 176 experienced by the internal shaft 66 and/or the bumper 60 and compare the compression 176 to a predetermined compression threshold 178 to determine a quality of engagement, such as whether the bumper 60 is adequately pressed against the tubular 38. To illustrate, when the grappling device 44, and more specifically, the internal shaft 66, is inserted into the tubular 38, the bumper 60 may press against the axial face 62 to block movement of the tubular 38 relative to the bumper 60, thereby enabling the inner shaft 66 to spin relative to the bumper 60 to actuate the grapples 64 as described herein. For the inner shaft 66 to spin relative to the bumper 60 and the tubular 38, the bumper 60 may be pressed against the axial face 62 with adequate force. Particularly, when the compression 176 experienced by the internal shaft 66 reaches or exceeds the compression threshold 178, the bumper 60 may be pressed against the axial face 62 with adequate force to block slipping of the bumper 60 on the axial face 62. Once the tubular measurement system 46 and/or the interlock system 54 determines that the bumper 60 is pressed against the axial face 62 with adequate force, the inner shaft 66 may be rotated to actuate the grapples 64 to radially extend and engage with the internal surface 67 of the tubular 38.

FIG. 12 depicts a torque-rotation relationship 180 that may be utilized by the interlock system 54 to determine a quality of engagement, such as whether the grappling device 44 is adequately coupled to the tubular 38 to support the weight of the tubular 38 and/or the drill string 28 as described above. To this end, the X-axis 182 represents rotations of the internal shaft 66 and the Y-axis 184 represents torque (e.g., shear stress) experienced by the internal shaft 66. In operation, the tubular measurement system 46 may gather data from various sensors 80 indicative of torque and rotation of the internal shaft 66, which may be transmitted to the interlock system 54 for analyzation. Based on the gathered data from the various sensors 80, the interlock system 54 may determine an actual torque-rotation profile 186. Based on the actual torque-rotation profile 186, the interlock system 54 may determine whether the grappling device 44 is adequately coupled to the tubular 38 in a number of ways.

For example, in some embodiments, the interlock system 54 may compare the actual torque-rotation profile 186 to a predetermined, theoretical torque-rotation profile 188 to determine whether the grappling device 44 is adequately coupled to the tubular 38. The theoretical torque-rotation relationship 188 may be stored in the memory 60 as a look-up table, graph, etc. The interlock system 54 may determine a calculated error (e.g., percent error, difference, etc.) between the torque-rotation profiles 186, 188 and determine whether the calculated error is within a predetermined error threshold. The error threshold may be between 0 and 0.01 percent, between 0 and 0.1 percent, between 0 and 1 percent, between 0 and 5 percent, or any other appropriate range. In other words, the interlock system 54 determine whether or not the torque-rotation profiles 186, 188 substantially match one another. For example, if the torque-rotation profiles 186, 188 substantially match (e.g., if the calculated error is within the predetermined error threshold), the interlock system 54 may determine that the grappling device 44 is sufficiently coupled to the tubular 38. However, if the torque-rotation profiles 186, 188 do not substantially match (e.g., if the calculated error exceeds the predetermined error threshold), the interlock system 54 may determine that the grappling device 44 is not sufficiently coupled to the tubular 38. If the interlock system 54 determines that the grappling device 44 is sufficiently coupled to the tubular 38, drilling rig 10 may continue with various drilling operations (e.g., a running operation as described above in FIGS. 3-10). However, if the interlock system 54 determines that the grappling device 44 is not sufficiently coupled to the tubular 38, measures may be taken to ensure a sufficient coupling between the grappling device 44 and tubular 38 before continuing with drilling operations.

Additionally, or in the alternative, the interlock system 54 may monitor the actual torque-rotation profile 186 as it relates to a grappling threshold 190 and a predicted amount of rotations 192 (e.g., predicted number of turns) to determine whether the grappling device 44 is adequately coupled to the tubular 38. For example, before the grapples 64 contact the internal surface 67 of the tubular 38 as discussed above in FIG. 2, the torque experienced by the internal shaft 66 may remain substantially constant. However, after a number of turns (e.g., the predicted amount of rotations 192), the grapples 64 may contact the internal surface 67 of the tubular 38, thereby increasing the torque experienced by the internal shaft 66. In other words, once the internal shaft 66 has rotated a sufficient amount relative to the bumper 60 to interface with the tubular 38, the tubular 38 may exert a reactive force on the grapples 64 and internal shaft 66 as the internal shaft 66 continues to rotate, thereby increasing the torque experienced by the internal shaft 66. Once the actual torque-rotation profile 186 has equaled or exceeded the torque threshold 190, the interlock system 54 may determine that the grappling device 44 is adequately coupled to the tubular 38. Indeed, in some embodiments, the tubular measurement system 46 may monitor the torque experienced by the internal shaft 66 relative to the torque threshold 190 independently of the rotations of the internal shaft 66 to determine whether the grappling device 44 is adequately coupled to the tubular 38. In some embodiments, the tubular measurement system 46 may monitor the rotation of the internal shaft 66 to determine whether or not the actual torque-rotation profile 186 meets the torque threshold 190 substantially at the predicted amount of rotations 192, or shortly thereafter (e.g., within 0.1 rotations of the predicted amount of rotations 192). That is, if the torque-rotation profile 186 meets the torque threshold 190 at approximately the predicted amount of rotations 192, the interlock system 46 and/or the tubular measurement system 46 may determine that the bumper 60 is held rigidly against the tubular 38 without slipping and the grapples 64 are adequately engaged with the tubular 38. Further, if the actual torque-rotation profile 186 meets the torque threshold 190 after predicted amount of rotations 192 (e.g., more than approximately 0.1 rotations relative to the predicted amount of rotations 192), the tubular measurement system 46 and/or the interlock system 54 may determine that the tubular 38 is experiencing slippage against the grapples 64 (e.g., left-hand rotation) and/or may determine that the grappling device 44 is not adequately coupled to the tubular 38. In some embodiments, the predicated amount of rotations may be approximately 1, 1.5, 2, 2.5, 3, 3.5, or between 2 and 3 rotations.

Indeed, the torque experienced by the internal shaft 66 as measured by the tubular measurement system 46 may be directly indicative of the gripping force of the grapples 64 on the tubular 38. Similarly, the rotations of the internal shaft 66, as measured by the tubular measurement system 46 may also be directly indicative of the gripping force of the grapples 64 on the tubular 38. Further, it should be noted that in some embodiments, the rotations of the internal shaft 66 may be measured relative to the bumper 60, which accordingly, may indicate the radial travel distance of the grapples 44. Further still, in some embodiments, the rotations of the internal shaft 66 may be measured relative to a permanent object (e.g., the ground), which may indicate a degree of slippage of the bumper 60 on the tubular 38 and/or a degree of slippage of the grapples 64 on the tubular 38.

Overall, if the interlock system 54 determines that the grappling device 44 is sufficiently coupled to the tubular 38, the drilling rig 10 may continue with various drilling operations (e.g., a running operation as described above in FIGS. 3-10). However, if the interlock system 54 determines that the grappling device 44 is not sufficiently coupled to the tubular 38, measures may be taken to ensure a sufficient coupling between the grappling device 44 and tubular 38 before continuing with drilling operations. For example, in some embodiments, fouling may occur on the internal surface 67 of the tubular 38 which may hinder the coupling between the grappling device 44 and the tubular 38. In such embodiments, if the interlock system 54 determines that the grappling device 44 is not sufficiently coupled to the tubular 38, the tubular 38 may be cleaned before being added to the drill string 28.

Further, in some embodiments, the interlock system 54 may also utilize the torque-rotation relationship 180 to determine whether the tubular 38 is adequately coupled to the drill string 28 during a running operation (e.g., adding the tubular 38 to the drill string 28) as described above in FIGS. 3-10. For example, the interlock system 54 may determine an actual torque-rotation profile (e.g., similar to the actual torque-rotation profile 186) based on data obtained from the tubular measurement system 46. Utilizing the torque-rotation profile, the interlock system 54 may determine an error relative to a theoretical torque-rotation profile, determine whether the torque-rotation profile meets a torque threshold, and when it meets the threshold relative to a predicted amount of rotations of the internal shaft 66 to achieve the torque threshold 190. Based on these determinations, the interlock system 54 may then determine whether the tubular 38 is adequately coupled to the drill string 28.

Furthermore, in some embodiments, to determine a quality of engagement, such as whether or not the grappling device 44 is adequately coupled to the tubular 38, the interlock system 54 may assess tension experienced by the internal shaft 66. For example, FIG. 13 depicts an embodiment of a tension-time relationship 193 measured by the tubular measurement system 46. Particularly, in the current embodiment, the X-axis 194 represents time and the Y-axis 196 represents tension 191 experienced by the internal shaft 66. For example, similarly as described in FIG. 6 above, in some embodiments, the top drive 44 may lift the grappling device 44 after the grapples 64 are adequately coupled to the tubular 38 and/or drill string 28 as described herein. While the top drive 42 is lifting the grappling device 44, the tubular measurement system 46 may measure a tension 191 (e.g., weight or downward force) acting on the top drive 42 or internal shaft 66. If the tension 191 exceeds a predetermined tension threshold 198, the interlock system 54 may determine that the grappling device 44 is adequately coupled to the tubular 38 and the drilling rig 10 may continue with various drilling operations (e.g., running operations). In some embodiments, the predetermined tension threshold 198 may be approximately the weight of the tubular 38. Further, the tension-time relationship 193, including the predetermined tension threshold 198 value, may be stored in the memory 60 of the interlock system 54.

The interlock system 54 and the drilling rig 10 described above may further include various modifications. For example, in certain embodiments, the grappling device 44 and/or the power slips 34 may have a default "closed" or "engaged" position (e.g., a gripping position), and the controller 56 may be configured to apply signals to "open" or "disengage" the grappling device 44 or the power slips 34 to release the tubular 38 or the drill string 28. In such an embodiment, the manual overrides 110 may be configured to release or open the grappling device 44 or the power slips 34.

Furthermore, in certain embodiments, the controller 56 may be programmed or configured for hysteresis control. For example, in circumstances where a measured weight supported by the grappling device 44 and/or the power slips 34 exceeds a predetermined threshold, the grappling device 44 and/or the power slips 34 may be actuated in a closed or "locked" position (e.g., automatically or by the controller 56). Additionally, the controller 56 may be configured to disable or disallow disengagement of the grappling device 44 and/or power slips 34 until the measured weight supported by the grappling device 44 and/or the power slips 34 falls below the predetermined threshold by a predetermined amount. In certain embodiments, the controller 56 may be further configured to disable or disallow disengagement of the grappling device 44 and/or power slips 34 until the measured weight supported by the grappling device 44 and/or the power slips 34 falls below the predetermined threshold by the predetermined amount for a set amount of time.

As discussed in detail above, present embodiments provide the grappling device 44, which is configured to grapple the internal surface of the tubular 38. To grapple to the tubular 38, the grappling device 44 may be inserted into the tubular 38 until the bumper 60 abuts the axial face 62 of the tubular 38. The bumper 60 may block rotation of the tubular 38 relative to the bumper 60. In this manner, the internal shaft 66 may rotate relative to the bumper 60 and the tubular 38, thereby actuating the grapples 64 to radially extend from the internal shaft 66 and grip the internal surface of the tubular 38. At the same time, the tubular measurement system 46 may measure data indicative of the grappling force of the grapples 64 on the tubular 38. The interlock system 54 may analyze this data to determine if the grapples 64 are adequately coupled to the tubular 38. Particularly, the interlock system 54 may compare the data to various parameter relationships to determine the adequacy of the coupling.

For example, as described herein, the tubular measurement system 46 may measure data indicative of a downward force of the bumper 60 on the tubular 38 (e.g., compressive or downward force experienced by the internal shaft 66 and/or the bumper 60). The tubular measurement system 46 and/or the interlock system 54 may utilize the data indicative of the downward force of the bumper 60 on the tubular 38 to determine that the bumper 60 is adequately engaged with the tubular 38 to enable rotation of the internal shaft 66 relative to the bumper 60 and radially extend the grapples 64. Further, the tubular measurement system 46 may measure data indicative of a torque experienced by the internal shaft 66. The tubular measurement system 46 and/or the interlock system 54 may utilize the data indicative of the torque experienced by the internal shaft 66 to determine the gripping force of the grapples 64 on the tubular 38, and to determine whether the tubular 38 is adequately gripped/supported by the grappling device 44. Further still, the tubular measurement system 46 may measure data indicative of rotations of the internal shaft 66. The tubular measurement system 46 and/or the interlock system 54 may utilize the data indicative of rotations of the internal shaft 66 to determine a radial travel distance of the grapples 64 to grip the tubular 38, and to further determine a gripping force of the grapples 64 on the tubular 38 based on the radial travel distance. In some embodiments, the tubular measurement system 46 and/or the interlock system 54 may utilize the data indicative of the rotations of the internal shaft 66 to determine slippage of the bumper 60 relative to the tubular 38 and/or to determine slippage of the grapples 64 relative to the tubular 38, which may also indicate a gripping force of the grapples 64 on the tubular 38.

The interlock system 54 is also configured to regulate and coordinate operation of one or more components of the drilling rig 10 during a casing running or tripping operation to ensure that lengths of tubular 38 and/or the drill string 28 of the drilling rig 10 are continually supported by the grappling device 44 and/or the power slips 34 of the drilling rig 10. In particular, the interlock system 54 is configured to regulate and coordinate operation of the grappling device 44 and the power slips 34 based on measured feedback associated with a casing running or tripping operation. For example, the interlock system 54 may utilize feedback from the tubular measurement system 46 and/or sensors 100 of the power slips 34, which are configured to measure forces (e.g., weight) acting on the grappling device 44 and the power slips 44 due to the tubular 38 and/or the drill string 28. Based on the measured feedback, the interlock system 54 may coordinate operation of the grappling device 44 and the power slips 34 to ensure that at least one of the grappling device 44 and the power slips 34 is supporting the weight of the tubular 38 and/or the drill string 28.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A system, comprising:

a casing running tool; and a tubular measurement system coupled to an internal shaft of the casing running tool and configured to measure data indicative of a grappling force of the casing running tool on a tubular, wherein the measured data indicative of the grappling force comprises a number of turns of the internal shaft and/or a torque experienced by the internal shaft, and wherein the tubular measurement system is configured to measure a downward force of a bumper of the casing running tool on an axial end of the tubular.

2. The system of claim 1, wherein the internal shaft of the casing running tool further comprises grapples, wherein the bumper of the casing running tool is configured to abut an axial end of the tubular and hold the bumper rotationally still relative to the tubular, and wherein the grapples are configured to radially extend toward an internal surface of the tubular when the internal shaft rotates relative to the bumper and the tubular.

3. The system of claim 1, comprising:

an interlock system configured to coordinate operation of the casing running tool and slips to ensure that at least one of the casing running tool and the slips is supporting weight of the tubular and weight of a drill string comprising the tubular, wherein the interlock system is configured to coordinate operation of the casing running tool and the slips based on measured feedback, and wherein the interlock system comprises the tubular measurement system, and the measured feedback comprises the measured data.

4. The system of claim 3, wherein the interlock system is configured to measure a first weight supported by the casing running tool, wherein the slips comprise at least one sensor configured to measure a second weight supported by the slips, and wherein the measured feedback comprises the first weight and/or the second weight.

5. The system of claim 3, wherein the interlock system comprises a first pressure switch configured to actuate the slips and a second pressure switch configured to actuate the casing running tool, and wherein the interlock system is configured to apply control signals to the first and second pressure switches.

6. The system of claim 5, wherein the first pressure switch is configured to detect a gripping force of the slips on the drill string, and the second pressure switch is configured to detect the grappling force of the casing running tool on the tubular.

7. The system of claim 3, wherein the interlock system comprises at least one mechanical override switch configured to interrupt control of the casing running tool and/or the slips by the interlock system.

8. A system, comprising:

a controller configured to coordinate operation of a grappling device of a top drive system to ensure that grapples of the grappling device are sufficiently engaged with a tubular to support a weight of the tubular, wherein the controller is configured to measure a downward force of a bumper of a casing running tool on an axial end of the tubular, wherein the controller is configured to determine a gripping force of the grappling device on the tubular based on measured feedback, and wherein the measured feedback comprises a torque experienced by an internal shaft of the grappling device and a number of rotations traveled by the internal shaft of the grappling device.

9. The system of claim 8, wherein the controller is configured to coordinate operation of the grappling device and slips of a drilling rig to ensure that at least one of the grappling device and the slips is engaged with the tubular and/or a drill string to support the weight of the tubular and/or weight of the drill string.

10. The system of claim 8, wherein the controller is configured to determine a quality of the engagement of the grappling device to the tubular based on a comparison of the downward force of the bumper to a predetermined compression threshold.

11. The system of claim 8, wherein the controller is configured to determine a quality of the engagement of the grappling device to the tubular based on a comparison of the torque and the number of rotations of the internal shaft to a theoretical torque-rotation profile.

12. The system of claim 8, wherein the controller is configured to determine a quality of the engagement of the grappling device to the tubular based on a comparison of the torque and the rotations traveled by the internal shaft to a predetermined torque threshold and a predicted number of rotations of the internal shaft.

13. A method, comprising:

inserting a grappling device of a tubular drive system of a drilling rig into a tubular;

abutting a bumper of the grappling device against an axial face of the tubular;

rotating an internal shaft of the grappling device relative to the bumper and the tubular, wherein rotating the internal shaft of the grappling device relative to the bumper and the tubular actuates grapples of the grappling device to radially extend toward an internal surface of the tubular;

measuring data indicative of a number of rotations of the internal shaft, a torque experienced by the internal shaft, and a downward force experienced by the internal shaft;

determining a grappling force of the grapples on the internal surface of the tubular based on the measured data.

14. The method of claim 13, wherein determining the grappling force of the grapples on the internal surface of the tubular comprises comparing the measured data to a predetermined torque-rotation profile, a predetermined torque threshold, a predicted number of rotations, a predetermined compression threshold, or any combination thereof.

15. The method of claim 13, comprising:

measuring a first weight of the tubular and/or a drill string supported by the grappling device;

measuring a second weight of the tubular and/or the drill string supported by slips of the drilling rig; and coordinating operation of the grappling device and the slips based on the first and second weights to ensure that at least one of the grappling device and the slips is supporting the first and second weights.

16. The method of claim 15, comprising wirelessly transmitting the first weight from a tubular measurement system configured to detect the first weight to a controller configured to coordinate operation of the grappling device and the slips.

17. The method of claim 15, comprising manually overriding the grappling device or the slips to disengage the grappling device or the slips.

18. The method of claim 15, comprising measuring a gripping force of the slips on the drill string with a first pressure switch, and measuring the grappling force of the grappling device on the tubular with a second pressure switch.

19. The method of claim 18, comprising coordinating operation of the grappling device and the slips based on the grappling and gripping forces to ensure that at least one of the grappling device and the slips is supporting the first and second weights.

* * * * *